US010101710B2

(12) United States Patent
Hasegawa

(10) Patent No.: US 10,101,710 B2
(45) Date of Patent: Oct. 16, 2018

(54) ELECTRONIC TIMEPIECE

(71) Applicant: CASIO COMPUTER CO., LTD., Shibuya-ku, Tokyo (JP)

(72) Inventor: Kosuke Hasegawa, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 112 days.

(21) Appl. No.: 14/754,511

(22) Filed: Jun. 29, 2015

(65) Prior Publication Data

US 2016/0018789 A1 Jan. 21, 2016

(30) Foreign Application Priority Data

Jul. 18, 2014 (JP) ..... 2014-147772

(51) Int. Cl.
*G04G 9/00* (2006.01)
*G04R 20/02* (2013.01)

(52) U.S. Cl.
CPC ..... *G04G 9/0076* (2013.01); *G04R 20/02* (2013.01)

(58) Field of Classification Search
CPC ..... G04G 5/02; G04G 5/04; G04G 5/041; G04G 5/043; G04G 5/045; G04G 9/0076; G04C 3/007; G04R 20/02
See application file for complete search history.

(56) References Cited

U.S. PATENT DOCUMENTS 5,724,316 A * 3/1998 Brunts ..... G01C 21/3697 340/988
6,366,834 B1 * 4/2002 Hayes ..... G04G 9/0076 340/988
6,559,796 B1 * 5/2003 Huber ..... G04R 20/02 342/354
6,876,600 B2 4/2005 Ito et al.
(Continued)

FOREIGN PATENT DOCUMENTS

JP 2000075070 A 3/2000
JP 2001337182 A 12/2001
(Continued)

OTHER PUBLICATIONS

Japanese Office Action (and English language translation thereof) dated Jun. 26, 2018 issued in Japanese Application No. 2017-102475.

*Primary Examiner* — Sean Kayes
(74) *Attorney, Agent, or Firm* — Holtz, Holtz & Volek PC

(57) ABSTRACT

An electronic timepiece includes a clocking unit, a storage unit, a setting selection unit which selects, as daylight saving time implementation information, daylight saving time implementation rule or user setting that specifies whether to implement summer time, and a local time acquisition unit which acquires local time at a predetermined point. The local time acquisition unit includes a movement determination unit which determines, when the setting selection unit selects the user setting, whether a previous point and a new point belong to a predetermined range in which local time
(Continued)

counted at the previous point is equal to local time counted at the new point, and a daylight saving time implementation information switching unit which acquires local time on the basis of the daylight saving time implementation rule when the previous point and the new point do not belong to the predetermined range.

20 Claims, 4 Drawing Sheets

(56) References Cited

U.S. PATENT DOCUMENTS

| | | | | |
|---|---|---|---|---|
| 8,542,557 | B2 * | 9/2013 | Oh | G04G 9/0076 368/21 |
| 8,937,851 | B2 * | 1/2015 | Matsuo | G04R 20/12 368/47 |
| 2002/0181333 | A1 | 12/2002 | Ito et al. | |
| 2005/0165543 | A1 * | 7/2005 | Yokota | G01C 21/3679 701/465 |
| 2013/0077448 | A1 * | 3/2013 | Matsuo | G04R 20/12 368/21 |

FOREIGN PATENT DOCUMENTS

| | | | |
|---|---|---|---|
| JP | 2004061445 | A | 2/2004 |
| JP | 2011048777 | A | 3/2011 |

* cited by examiner

| AREA NUMBER | TIME DIFFERENCE | DAYLIGHT SAVING TIME PERIOD | SHIFT TIME |
|---|---|---|---|
| G21 | +10 | 0 | 0 |
| G22 | +10 | 0 | 0 |
| G23 | +10 | 11 | +1 |
| G24 | +10 | 0 | 0 |
| G25 | +9.5 | 0 | 0 |
| G26 | +9.5 | 11 | +1 |
| G27 | +9 | 0 | 0 |

FIG.3

| | | | | | | | | | | | |
|---|---|---|---|---|---|---|---|---|---|---|---|
| 1 G19 | 2 G19 | 3 G16 | 4 G16 | 5 G16 | 6 G13 | 7 G13 | 8 G13 | 9 G13 | 10 G13 | 11 G13 | 12 G11 |
| 13 G19 | 14 G19 | 15 G16 | 16 G16 | 17 G16 | 18 G13 | 19 G13 | 20 G13 | 21 G13 | 22 G13 | 23 G13 | 24 G11 |
| 25 G20 | 26 G20 | 27 G20 | 28 G17 | 29 G17 | 30 G14 | 31 G14 | 32 G14 | 33 G11 | 34 G11 | 35 G11 | 36 G11 |
| 37 G20 | 38 G20 | 39 G20 | 40 G18 | 41 G18 | 42 G14 | 43 G14 | 44 G14 | 45 G11 | 46 G11 | 47 G11 | 48 G11 |
| 49 G18 | 50 G18 | 51 G18 | 52 G18 | 53 G18 | 54 G14 | 55 G14 | 56 G14 | 57 G11 | 58 G11 | 59 G11 | 60 G11 |
| 61 G18 | 62 G18 | 63 G18 | 64 G18 | 65 G18 | 66 G15 | 67 G15 | 68 G15 | 69 G15 | 70 G12 | 71 G12 | 72 G12 |
| 73 G18 | 74 G18 | 75 G18 | 76 G18 | 77 G18 | 78 G15 | 79 G15 | 80 G12 | 81 G12 | 82 G12 | 83 G12 | 84 G12 |
| 85 G18 | 86 G18 | 87 G18 | 88 G18 | 89 G18 | 90 G15 | 91 G15 | 92 G12 | 93 G12 | 94 G12 | 95 G12 | 96 G12 |

ELECTRONIC TIMEPIECE

BACKGROUND OF THE INVENTION

1. Field of the Invention

The present invention relates to an electronic timepiece.

2. Description of Related Art

Japanese Patent Application Laid Open Publication No. 2011-48777 which is a Japanese patent document discloses an example of an electronic timepiece which can shift date and time to be counted and displayed during an implementation period of Daylight Saving Time from standard time to daylight saving time. In this electronic timepiece, daylight saving time implementation rules for respective areas are stored in advance, a daylight saving time implementation rule of a set area is read out, and the date and time is shifted from the standard time by a shift time and counted and displayed during the daylight saving time implementation period in the area.

Conventionally, there have been electronic timepieces which have a function of displaying date and time corresponding to a position (local time) on the basis of positional information that is set by a user or acquired via radio waves. Such electronic timepieces enable the display of local time of an area without user's operation or only requiring an easy operation when the user moves to a different time zone for a trip or such like.

However, there is a case where daylight saving time should not be displayed at a specific position depending on how the user uses the electronic timepiece, and there is a case where the daylight saving time implementation rule is changed and needs to be manually switched to a daylight saving time implementation rule different from the stored daylight saving time implementation rule. With respect to this, in some electronic timepieces, the user can set not to correspond to daylight saving time automatically, or the user can manually set daylight saving time to be implemented and shift time by a predetermined time (for example, 1 hour).

However, in the electronic timepieces which enable manual setting not to correspond to daylight saving time automatically, when the manual setting is maintained in a case where the user moves to a different area for a trip or the like, the user cannot easily acquire local time information which takes into account implementation/non-implementation of daylight saving time at the travel destination.

An object of the present invention is to provide an electronic timepiece which can easily acquire date and time information taking into account daylight saving time at a new location regardless of usual usage of the electronic timepiece.

SUMMARY OF THE INVENTION

In order to achieve one of the above objects, according to one aspect of the present invention, there is provided an electronic timepiece including: a clocking unit which counts current date and time; a storage unit in which a daylight saving time implementation rule set for each area is stored; a setting selection unit which selects, as daylight saving time implementation information, the daylight saving time implementation rule or user setting that specifies whether to implement daylight saving time; and a local time acquisition unit which acquires local time at a predetermined point by using the daylight saving time implementation information, wherein the local time acquisition unit includes: a movement determination unit which determines, when the setting selection unit selects the user setting, whether a previous point and a new point belong to a predetermined range in which local time counted at the previous point is equal to local time counted at the new point, the previous point being a position where local time is previously acquired, and the new point being a position where local time is to be newly acquired; and a daylight saving time implementation information switching unit which acquires local time on the basis of the daylight saving time implementation rule when the previous point and the new point do not belong to the predetermined range.

BRIEF DESCRIPTION OF THE DRAWINGS

The above and other objects, advantages and features of the present invention will become more fully understood from the detailed description given hereinafter and the appended drawings which are given by way of illustration only, and thus are not intended as a definition of the limits of the present invention, and wherein:

FIG. 3 is a diagram showing an example of section division using a two-dimensional map;

DETAILED DESCRIPTION OF THE PREFERRED EMBODIMENT

Hereinafter, an embodiment of the present invention will be described on the basis of the drawings.

Figures 1, 2:
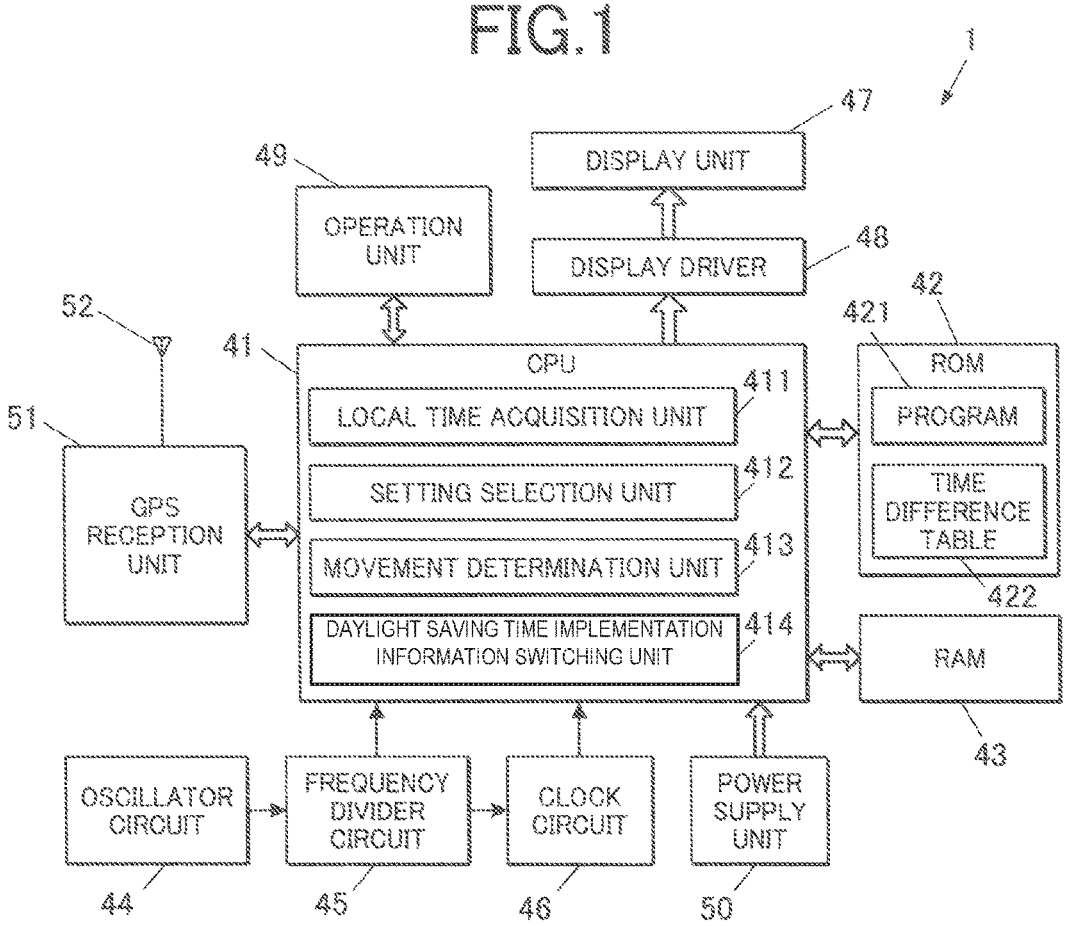
FIG. 1 is a block diagram showing a functional configuration of an electronic timepiece in an embodiment of the present invention.
FIG. 2 is a diagram showing apart of an example of contents of time difference table.

FIG. 1 is a block diagram showing a functional configuration of an electronic timepiece 1 in an embodiment of the present invention.

The electronic timepiece 1 includes a CPU 41 (Central Processing Unit) (local time acquisition unit 411, setting selection unit 412, movement determination unit 413 and daylight saving time implementation information switching unit 414), a ROM 42 (Read Only Memory) (storage unit), a RAM 43 (Random Access Memory), an oscillator circuit 44, a frequency divider circuit 45, a clock circuit 46 (clocking unit), a display unit 47 (display unit), a display driver 48, an operation unit 49 (operation unit), a power supply unit 50, a GPS reception unit 51 (positioning unit), a reception antenna thereof 52 and such like.

The CPU 41 carries out various calculation processes and comprehensively controls the entire operation of the electronic timepiece 1. The CPU 41 loads control programs read out from the ROM 42 into the RAM 43 to perform various types of operation processing such as display of date and time and calculation control and display according to various functions. The CPU 41 also operates the GPS reception unit 51 to acquire date and time information and positional information by receiving radio waves from positioning satellites. The CPU 41 includes a local time acquisition unit 411, setting selection unit 412, movement determination unit 413 and daylight saving time implementation information switching unit 414. The local time acquisition unit 411, setting selection unit 412, movement determination unit 413 and daylight saving time implementation information switching unit 414 may be a single CPU or may be provided as separate CPUs to perform respective operations.

The ROM 42 is a mask ROM, a rewritable non-volatile memory and such like. Control programs and initial setting data are stored in the ROM 42 in advance. The control programs include a program 421 according to control of various types of processing for acquiring various types of information from positioning satellites. The initial setting data includes a time difference table 422 which stores information according to a time zone to which each of divided areas in the world belongs and information according to daylight saving time implementation rule, for example. The time difference table 422 will be described later.

The RAM 43 is a volatile memory such as a SRAM and a DRAM which stores temporary data by providing a working memory to the CPU 41 and stores various types of setting data. The various types of setting data include home city setting of electronic timepiece 1 and setting according to whether to apply daylight saving time in counting and display of date and time.

The oscillator circuit 44 generates and outputs predetermined frequency signals. The oscillator circuit 44 includes, for example, a crystal oscillator.

The frequency divider circuit 45 divides a frequency signal input from the oscillator circuit 44 into signals having frequencies to be used in the clock circuit 46 and the CPU 41. The frequencies of the output signals may be changeable on the basis of setting by the CPU 41. Also, the signals may be output remaining the frequency of the oscillator circuit 44.

The clock circuit 46 counts the current date and time by counting the number of input signals and adding the counted value to the initial value. The clock circuit 46 may change a value stored in the RAM by software or may include a dedicated counter circuit. Though not especially limited, the date and time counted by the clock circuit 46 is an accumulated time from a predetermined timing, UTC date and time (Coordinated Universal Time), date and time of a preset home city (local time) or such like. The date and time itself counted by the clock circuit 46 does not necessarily need to be maintained in the form of year, month, day, hour, minute and second.

The display unit 47 includes a display screen such as a liquid crystal display (LCD) and an organic EL (Electro-Luminescent) display, for example, and performs digital display operation according to date and time and various functions by either one or a combination of the dot matrix system and the segment system. The display driver 48 outputs a drive signal corresponding to the type of display screen to the display unit 47 on the basis of the control signal from the CPU 41 and performs display on the display screen.

The operation unit 49 receives an input operation from a user and outputs an electric signal corresponding to the input operation as an input signal to the CPU 41. The operation unit 49 includes push button switches and a crown switch, for example.

Alternatively, the display unit 47 and the operation unit 49 may be integrally provided by providing a touch sensor so as to be superposed on the display screen of the display unit 47 and making the touch sensor function as a touch panel which outputs an operation signal corresponding to a touch position and a touch manner according to the user's touch operation to the touch sensor.

The power supply unit 50 supplies electric power according to the operation of the electronic timepiece 1 to the units at a predetermined voltage. Here, a solar battery and a secondary cell are used as the power supply unit 50. The solar battery generates an electromotive force by incident light to a solar panel to supply electric power to the units such as the CPU 41. When excess electric power is generated, the solar battery charges the secondary cell with the electric power. On the other hand, when the electric power which can be generated from the incident light to the solar panel from outside is insufficient compared to the consumed power, the electric power is supplied from the secondary cell.

The GPS reception unit 51 is tuned to radio waves from positioning satellites via the reception antenna 52 and receives the radio waves by identifying and acquiring C/A code (pseudorandom noise) and demodulates and decodes navigation message transmitted by the positioning satellites to acquire necessary information. When acquiring positioning information, the GPS reception unit 51 demodulates and decodes navigation messages with respect to a plurality of positioning satellites, calculates the current position by using the obtained data and outputs the position as current position information. A module formed as one chip of dedicated processing circuit is generally used as the GPS reception unit 51. The GPS reception unit 51 includes a CPU to perform control and a storage unit to store setting data, predicted orbit information of positioning satellites and such like, separately from the CPU 41, ROM 42 and RAM 43. The electric power is directly supplied from the power supply unit 50 to the GPS reception unit 51 and the on/off thereof is switched by a control signal from the CPU 41.

Next, daylight saving time application operation to displayed date and time in the electronic timepiece 1 of the embodiment will be described.

In the electronic timepiece 1, daylight saving time application setting can be switched to any one of automatic mode (AUTO) manual application mode (DST) and manual release mode (STD) on the basis of user's input operation to the operation unit 49. The setting is stored in the RAM 43. In the manual application mode (DST) and the manual release mode (STD), implementation/non-implementation of daylight saving time is set (user setting) by user's input operation.

When the daylight saving time application setting is switched, or when date and time information is newly acquired, the daylight saving time application setting is referred to, the daylight saving time implementation information corresponding to the setting is acquired with respect to the local time of the area to be displayed (a predetermined point), and new date and time data is obtained by shifting from standard time to daylight saving time as needed and used for display.

FIG. 2 is a diagram showing an example of a part of contents of the time difference table 422.

The daylight saving time implementation rule which is applied to date and time data as the daylight saving time implementation information in the automatic mode is stored in the time difference table 422. In the time difference table 422, the time difference and daylight saving time implementation rule are set in advance for each section obtained by dividing each area in the world into a plurality of sections. The daylight saving time implementation rule includes an implementation period of time and a shift time of daylight saving time. In the time difference table 422, an area number unique to an area is assigned to each of the areas which are set so that points having different time zones and/or daylight saving time implementation rules belong to different areas. The areas may be divided by predetermined administrative unit such as country and state in addition to the time zone and daylight saving time implementation rule.

Each of the sections is obtained by divisional setting of geographically nearly equal range (that is, equal width or the like according to latitude and longitude of geographical coordinate), for example. Accordingly, by uniformly dividing the world by area quantity sufficiently smaller than the setting range of time zone and daylight saving time implementation rule, the boundaries between respective sections can be easily set and points having different time zones or daylight saving time implementation rules can be included in different sections within a minute error range.

The data indicating a range or boundary of each section in this case may be stored together in the time difference table 422. Alternatively, a two-dimensional map (world map) which acquires geographical coordinate (latitude and longitude) by performing conversion into section and area number may be additionally provided so that information regarding the time difference and the daylight saving time implementation rule corresponding to the acquired section is referred to.

FIG. 3 is a diagram showing an example of section division using the two-dimensional map.

Here, a part of the world is divided into 96 sections by 8.times.12 matrices as an example. Any one of ten area numbers G11 to G20 shown at the lower portion of each matrix element is assigned to each of the 96 sections. In such way, it is possible to acquire the time difference and the daylight saving time implementation rule corresponding to a section by easily acquiring the section and the area number from the geographical coordinate and referring to the time difference table 422. The section division is set appropriately according to the processing ability of electronic timepiece 1 since a larger number of sections more facilitate division along the boundaries of time zone and application of daylight saving time implementation rule while increasing the amount of processing and memory capacity.

FIG. 2 shows settings of four sections having the time difference of +10 hours, two sections having the time difference of +9.5 hours and one section having the time difference of +9 hours (corresponding to Japan) with respect to UTC date and time (GMT). Here, only the sections having area numbers different from each other are illustrated; however, a plurality of sections can belong to a same area.

A period number corresponding to the type of implementation period is indicated as the daylight saving time implementation period of time. For example, the daylight saving time period "0" indicates that daylight saving time is not implemented. The daylight saving time period "11" indicates that daylight saving time is implemented during a period of time from 2:00 a.m. on the 1st Sunday of October to 3:00 a.m. on the 1st Sunday of April, for example. In this case, a comparison table (not shown in the drawings) relating period numbers to respective actual periods is provided so that the implementation period corresponding to the period number is referred to. Alternatively, these periods may be directly stored in the time difference table 422.

The shift time indicates the amount of shift from standard time during the implementation period of daylight saving time. The shift time of "0" is stored in a case where daylight saving time is not implemented, and the shift time of a value other than "0" is stored in a case where daylight saving time is implemented. When the daylight saving time application setting is the manual application mode in an area which is originally a daylight saving time implementation area, only the shift time is read out to be used. On the other hand, when daylight saving time is applied manually in an area which is not originally a daylight saving time implementation area, the shift is performed by a predetermined initial value, for example, +1 hour. The initial value may be changeable by user's input operation to the operation unit 49.

When UTC date and time is acquired by receiving radio waves from GPS satellite, the two-dimensional map and the time difference table 422 are referred to, and the time difference (TZ) and the shift amount (ST) according to daylight saving time are acquired on the basis of the position (city) which is set in the electronic timepiece 1 in advance and the current position acquired together by the radio wave reception. Then, the local time (LT) of the area to which the current position belongs is obtained by LT=UTC+TZ+ST.

Next, date and time correction operation in the electronic timepiece 1 will be described.

FIG. 4 is a flow chart showing a control procedure of GPS date and time acquisition processing executed by the CPU 41 in the electronic timepiece 1 in the embodiment.

The GPS date and time acquisition processing is executed periodically once a day at a timing when a predetermined condition is satisfied first and executed as needed on the basis of the input operation to the operation unit 49, for example. The predetermined condition is, for example, a timing when electric generation electromotive force is obtained by a solar battery with a light amount of intensity equivalent to outdoor sunlight, for example.

Figure 4A:
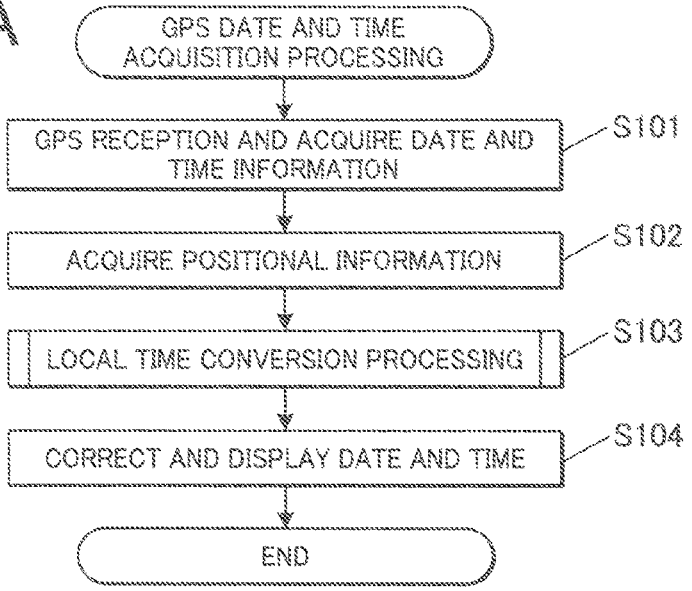
FIG. 4A is a flow chart showing a control procedure of GPS date and time acquisition processing.

As shown in FIG. 4A, when the GPS date and time acquisition processing is started, the CPU 41 operates the GPS reception unit 51 to make the CPU of the GPS reception unit 51 start receiving radio waves from positioning satellites such as GPS satellite and calculate date and time, and acquires information regarding the calculated date and time (step S101). The CPU 41 also acquires the current position information (step S102) In a case where the position information is calculated in the GPS reception unit 51 by positioning operation of the GPS reception unit 51, the current position information is acquired from the GPS reception unit 51. In a case where the current position information is not acquired from the GPS reception unit 51, the position of the city which is set in the electronic timepiece 1 and stored in the RAM 43 at this time is acquired.

The CPU 41 executes after-mentioned local time conversion processing (step S103). The CPU 41 corrects date and time of the clock circuit 46 and corrects date and time displayed on the display unit 47 (step S104). Then, the CPU 41 ends the GPS date and time acquisition processing.

Figure 4B:
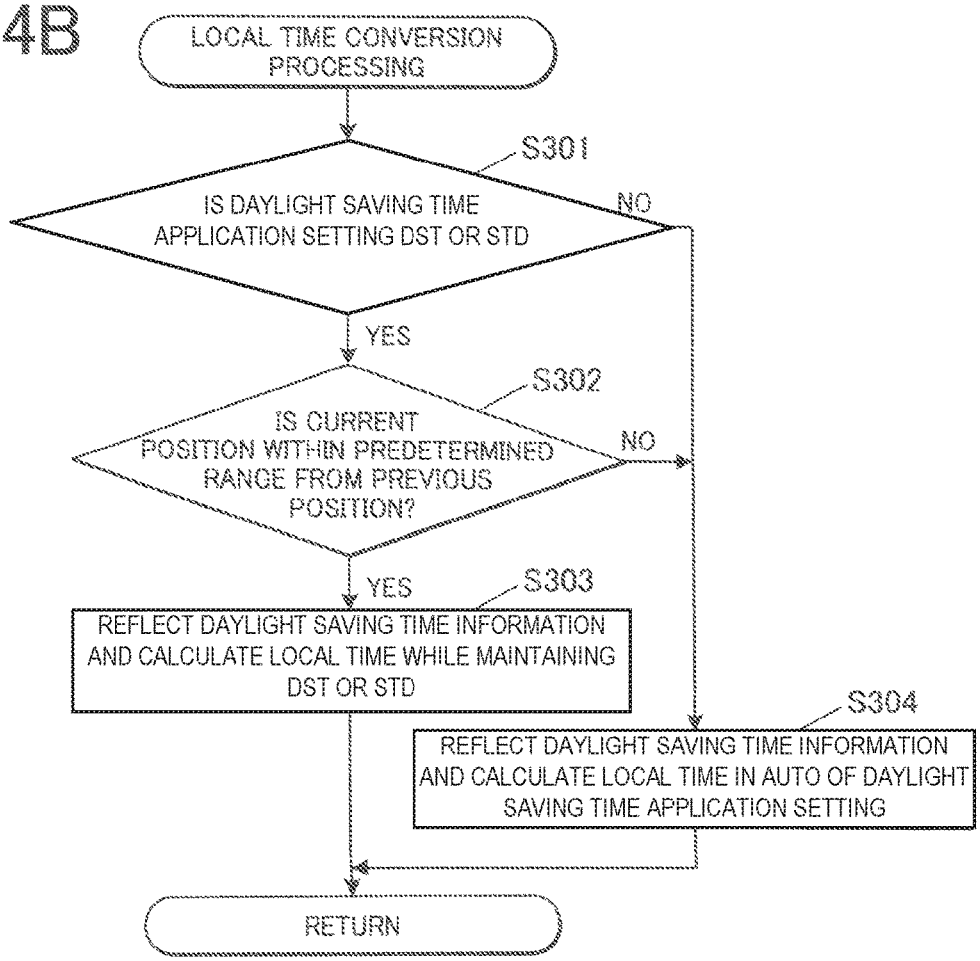
FIG. 4B is a flow chart showing a control procedure of local time conversion processing.

When the local time conversion processing is invoked in the processing of step S103, as shown in FIG. 4B, the CPU 41 determines whether the current daylight saving time application setting is the manual application mode (DST) or the manual release mode (STD) (step S301). If it is determined that the current daylight saving time application setting is not the manual application mode (DST) nor the manual release mode (STD) (step S301: NO), the CPU 41 calculates the local time by applying the time difference and the daylight saving time implementation rule corresponding to the current position acquired in the processing of step S102 while remaining the automatic mode (AUTO) which is the current daylight saving time application setting (step S304). Then, the CPU 41 ends the local time conversion processing and returns the processing to the GPS date and time acquisition processing.

If it is determined that the current daylight saving time application setting is the manual application mode (DST) or the manual release mode (STD) (step S301: YES), the CPU 41 determines whether the current position (new point) acquired in the processing of step S102 is within a predetermined range from the previously acquired position (previous point) (step S302), The predetermined range is within an area of the same area number, for example.

If it is not determined that the current position and the previous position are located within the predetermined range (step S302: NO), the CPU 41 changes the daylight saving time application setting to the automatic mode (AUTO), and calculates the local time by applying the time difference and daylight saving time implementation rule corresponding to the current position (step S304). Then, the CPU 41 ends the local time conversion processing and returns the processing to the GPS date and time acquisition processing.

On the other hand, if it is determined that the current position and the previous position are located within the predetermined range (step S302: YES), the CPU 41 maintains the daylight saving time application setting to be the current setting, that is, the manual application mode (DST) or the manual release mode (STD), acquires the time difference corresponding to the current position from the time difference table 422 and calculates the local time in which the time difference and daylight saving time are reflected (step S303). Then, the CPU 41 ends the local time conversion processing and returns the processing to the GPS date and time acquisition processing.

Figure 5:
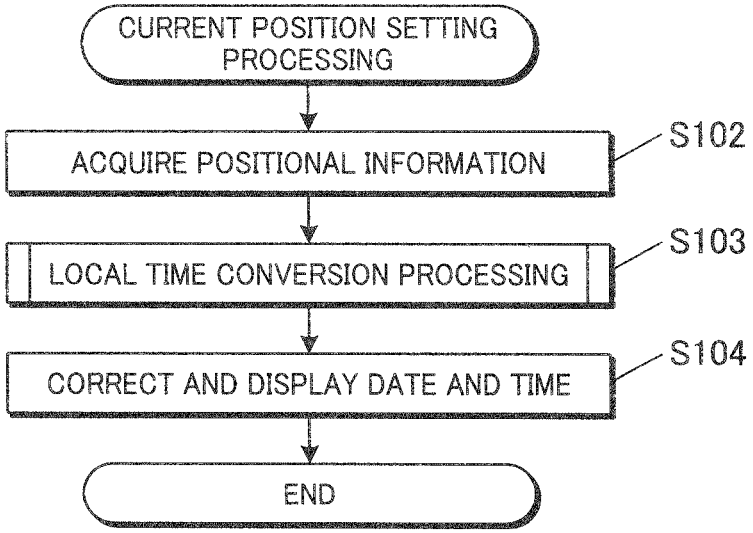
FIG. 5 is a flow chart showing a control procedure of current position setting processing.

FIG. 5 is a flow chart showing a control procedure of the current position setting processing executed by the CPU 41 in the electronic timepiece 1 of the embodiment.

The current position setting processing is similar to the GPS date and time acquisition processing except that the processing of step S101 of the above-mentioned GPS date and time acquisition processing is omitted, and thus, the explanation according to individual processing contents is omitted.

That is, without relation to the acquisition of date and time information from the positioning satellites, the current position setting processing is executed at the timing when the current position information is set according to the user's operation, the reception of positional information from outside or such like. Then, the local time is calculated according to the difference between the current position and the original position.

As described above, the electronic timepiece 1 in the embodiment includes the clock circuit 46 which counts the current date and time, the ROM 42 in which a daylight saving time implementation rule set for each area is stored, and the CPU 41. The CPU 41 (setting selection unit 412) selects, as the daylight saving time implementation information, the daylight saving time implementation rule or user setting specifying whether to implement daylight saving time. The CPU 41 (local time acquisition unit 411) acquires local time at a predetermined point by using the daylight saving time implementation information. Furthermore, in a case where the user setting is selected as the daylight saving time implementation information, the CPU 41 (movement determination unit 413) determines whether the previous point and the new point belong to a predetermined range in which the local time counted at the previous point is equal to the local time counted at the new point, the previous point being a position where local time was previously acquired, and the new point being a position where local time is to be newly acquired. If the previous point and the new point are not located within the predetermined range, the CPU 41 (daylight saving time implementation information switching unit 414) acquires the local time on the basis of the daylight saving time implementation rule.

By such configuration, in a case where the daylight saving time implementation rule is locally changed and the setting according to the implementation/non-implementation of daylight saving time is performed manually, for example, the daylight saving time implementation rule is applied appropriately at the new location. Also, even in a case where the user has temporarily released the daylight saving time setting, when the usage is changed at the new location or the like, the manual setting is once returned to the normal display to which the daylight saving time implementation rule is applied. Thus, it is possible to avoid confusion by displaying exact local time. That is, it is possible to easily acquire date and time information taking into account daylight saving time at the new location regardless of general use of the electronic timepiece.

The electronic timepiece 1 further includes the GPS reception unit 51 which acquires the current position information, and the CPU 41 acquires local time corresponding to the current position information in a case where the current position information is acquired by the GPS reception unit 51. Accordingly, when the user moves, it is determined whether the local time needs to be calculated by using the daylight saving time implementation rule immediately, and the time can be switched if necessary. Thus, it is possible to avoid inaccurate daylight saving time display at the new location.

The same daylight saving time implementation rule as that of the previous point is applied in the predetermined range, and the predetermined range belongs to the same time zone as the previous point. Thus, it is possible to display exact daylight saving time by surely applying daylight saving time implementation rule as the daylight saving time implementation information when the local time is changed and by not changing the daylight saving time implementation information when the local time is not changed.

Furthermore, since the predetermined range is set to be within a predetermined administrative unit, it is easy to correspond to a case where a different daylight saving time implementation rule will be possibly set in a neighboring country in the future, for example.

The daylight saving time implementation rule is stored for each section which does not straddle the inside and the outside of the predetermined range according to geographical coordinate. When positional information of a new point is acquired, the daylight saving time implementation rule corresponding to the geographical coordinate of the position is readout. Thus, the relation between the position and the daylight saving time implementation rule is not complicated and it is possible to read out necessary daylight saving time implementation rule by simplified processing.

The electronic timepiece 1 further includes the display unit 47 which displays the acquired local time, and the CPU 41 acquires the local time every time the display by the display unit 47 is updated. Thus, it is possible to display the local time on the basis of the exact current position in nearly real time.

The electronic timepiece 1 includes the operation unit 49 for inputting user setting according to implementation/non-implementation of daylight saving time. Thus, in a case where the user wishes to adjust daylight saving time display temporarily at a predetermined position in addition to a case where the daylight saving time implementation rule is changed, the operation can be performed easily. Furthermore, when the current position is changed after such operation, it is possible to count and display exact local time easily and surely.

The present invention is not limited to the above embodiment, and various changes can be made.

For example, in the embodiment, information according to time difference and daylight saving time implementation rule is set and stored in the time difference table 422 for each of all the sections; however, only the information according to time difference and daylight saving time implementation rule for each area may be set so as to be referred to on the basis of the area number. In this case, the information reference based on the area number may be performed by setting the areas to be equal to sections and directly converting the geographical coordinates into area numbers.

In the embodiment, the sections are divided nearly evenly; however, parts in a same country, state or the like in which the daylight saving time implementation rule is not changed widely may not be divided finely. In a case where the section or area number is identified by using a two-dimensional map, the processing can be performed relatively easily even when the boundaries are not set along specific latitude and longitude lines.

In the embodiment, the setting to determine implementation/non-implementation of daylight saving time is performed by user's input operation to the operation unit 49; however, the setting may be obtainable from an external device via a communication unit such as Bluetooth (registered trademark).

In the embodiment, the daylight saving time application setting is switched from user setting according to implementation/non-implementation of daylight saving time to a daylight saving time implementation rule in response to the change of area number; however, the present invention is not limited to this. The switching may be performed even within a same area according to movement for a predetermined distance or more or movement to another section.

In the embodiment, the acquired local time is displayed; however, the acquired local time may be only counted to be used for various notification operations such as alarm function.

In the embodiment, an atomic clock which receives radio waves from GPS satellite is described as an example; however, it is not necessary to receive radio waves from positioning satellites as long as the positional information can be acquired and set. The date and time may be corrected on the basis of standard waves in the long-wavelength range or date and time information from a portable base station, for example.

In the embodiment, the display unit 47 includes digital display function; however, as long as the date and time can be displayed, the electronic timepiece 1 may be an analog electronic timepiece which performs display by hands pointing in directions.

The other specific details described in the embodiment such as the configurations, control contents and procedures may be modified appropriately within the scope of the present invention.

Though several embodiments of the present invention have been described above, the scope of the present invention is not limited to the above embodiments, and includes the scope of inventions, which is described in the scope of claims, and the scope equivalent thereof.

The entire disclosure of Japanese Patent Application No. 2014-147772 filed on Jul. 18, 2014 including description, claims, drawings, and abstract are incorporated herein by reference in its entirety.

What is claimed is:

1. An electronic timepiece comprising:

a clock circuit which counts a current date and time;

a memory storing a daylight saving time implementation rule set for each of a plurality of areas; and a processor configured to execute a program stored in a memory to perform operations including:

selectively setting, as a daylight saving time application setting, one of (i) an automatic mode to implement or not implement daylight saving time according to the daylight saving time implementation rule set for each of the plurality of areas stored in the memory, and (ii) a manual mode to locally change the daylight saving time implementation rule for an area so as to manually implement or manually not implement daylight saving time in the area according to a user input; and a local time acquisition process to acquire a local time at a current position, the local time acquisition process comprising:

determining whether the automatic mode or the manual mode is set as the daylight saving time application setting;

when the manual mode is set as the daylight saving time application setting:

determining whether the current position is within the same area as a previous position at which the local time was acquired, the area being a range in which the local time is the same;

changing the manual mode to the automatic mode when the current position is determined not to be within the same area as the previous position; and acquiring the local time at the current position while applying the locally changed daylight saving time implementation rule in the manual mode so as to manually implement or manually not implement daylight saving time in the area according to the user input, when the current position is determined to be within the same area as the previous position; and when the automatic mode is set as the daylight saving time application setting, acquiring the local time at the current position while implementing or not implementing daylight saving time in the automatic mode according to the daylight saving time implementation rule stored in the memory for the current position.

2. The electronic timepiece according to claim 1, further comprising:

a positioning unit which acquires current position information, wherein processor executes the local time acquisition process when the positioning unit acquires the current position information.

3. The electronic timepiece according to claim 1, wherein the area for which the daylight saving time implementation rule is locally changed in the manual mode is in a single time zone.

4. The electronic timepiece according to claim 2, wherein the area for which the daylight saving time implementation rule is locally changed in the manual mode is in a single time zone.

5. The electronic timepiece according to claim 3, wherein the area for which the daylight saving time implementation rule is locally changed in the manual mode is within a predetermined administrative unit.

6. The electronic timepiece according to claim 4, wherein the area for which the daylight saving time implementation rule is locally changed in the manual mode is within a predetermined administrative unit.

7. The electronic timepiece according to claim 1, wherein each of the areas for which a daylight saving time implementation rule is stored in the memory is an area in which the local time is the same.

8. The electronic timepiece according to claim 2, wherein each of the areas for which a daylight saving time implementation rule is stored in the memory is an area in which the local time is the same.

9. The electronic timepiece according to claim 3, wherein each of the areas for which a daylight saving time implementation rule is stored in the memory is an area in which the local time is the same.

10. The electronic timepiece according to claim 4, wherein each of the areas for which a daylight saving time implementation rule is stored in the memory is an area in which the local time is the same.

11. The electronic timepiece according to claim 5, wherein each of the areas for which a daylight saving time implementation rule is stored in the memory is an area in which the local time is the same.

12. The electronic timepiece according to claim 6, wherein each of the areas for which a daylight saving time implementation rule is stored in the memory is an area in which the local time is the same.

13. The electronic timepiece according to claim 1, further comprising:

a display;

wherein the processor controls the display to display the acquired local time; and wherein the processor executes the local time acquisition process every time display by the display is updated.

14. The electronic timepiece according to claim 2, further comprising:

a display;

wherein the processor controls the display to display the acquired local time; and wherein the processor executes the local time acquisition process every time display by the display is updated.

15. The electronic timepiece according to claim 3, further comprising:

a display;

wherein the processor controls the display to display the acquired local time; and wherein the processor executes the local time acquisition process every time display by the display is updated.

16. The electronic timepiece according to claim 4, further comprising:

a display;

wherein the processor controls the display to display the acquired local time; and wherein the processor executes the local time acquisition process every time display by the display is updated.

17. The electronic timepiece according to claim 5, further comprising:

a display;

wherein the processor controls the display to display the acquired local time; and wherein the processor executes the local time acquisition process every time display by the display is updated.

18. The electronic timepiece according to claim 6, further comprising:

a display;

wherein the processor controls the display to display the acquired local time; and wherein the processor executes the local time acquisition process every time display by the display is updated.

19. The electronic timepiece according to claim 7, further comprising:

a display;

wherein the processor controls the display to display the acquired local time; and wherein the processor executes the local time acquisition process every time display by the display is updated.

20. The electronic timepiece according to claim 1, further comprising an operation unit which is operable by a user to set the manual mode.

* * * * *